US008317123B1

(12) United States Patent
Erdie

(10) Patent No.: US 8,317,123 B1
(45) Date of Patent: Nov. 27, 2012

(54) SHEET ROLLING DEVICE

(75) Inventor: Jason S. Erdie, Richfield, OH (US)

(73) Assignee: Erdie End Caps, LLC, Lorain, OH (US)

( * ) Notice: Subject to any disclaimer, the term of this patent is extended or adjusted under 35 U.S.C. 154(b) by 312 days.

(21) Appl. No.: 12/842,123

(22) Filed: Jul. 23, 2010

(51) Int. Cl.
*B65H 75/24* (2006.01)

(52) U.S. Cl. ..... 242/529; 242/532.5; 242/534.2; 242/539; 242/575; 242/576.1; 242/586

(58) Field of Classification Search ..... 242/528, 242/529, 532, 532.5, 532.6, 532.7, 534, 534.2, 242/539, 571, 575, 576.1, 579, 586; 53/430, 53/493, 504, 116, 117, 118, 119
See application file for complete search history.

(56) References Cited

U.S. PATENT DOCUMENTS 6,606,839 B1 * 8/2003 Suda et al. ..... 53/430
6,983,578 B1 * 1/2006 Suda et al. ..... 53/475
7,296,730 B2 11/2007 Erdie

* cited by examiner

*Primary Examiner* — William E Dondero
(74) *Attorney, Agent, or Firm* — Rankin, Hill & Clark LLP

(57) ABSTRACT

A sheet rolling device includes a mandrel that selectively retains the sheet stock between a sidewall of the mandrel and a gripper blade of the mandrel. The sheet rolling device also includes a sensor that detects a presence and an absence of the sheet stock near the mandrel, a controller operably associated with the mandrel so as to cause a motor to rotate the mandrel to wind the sheet stock around the mandrel, and an expansion leaf operably associated with the controller and situated along at least a portion of an exterior of the sidewall of the mandrel. Extension of the expansion leaf away from the sidewall increases an effective perimeter of the mandrel about which the sheet stock may be wound and retraction of the expansion leaf toward the sidewall decreases the effective perimeter of the mandrel about which the sheet stock may be wound.

20 Claims, 11 Drawing Sheets

SHEET ROLLING DEVICE

BACKGROUND OF INVENTION

1. Field of Invention

Exemplary embodiments herein relate to a device for rolling sheet stock into cylindrical form that may be inserted into a shipping container.

2. Description of Related Art

When shipping posters and other items printed on sheet stock (e.g., architectural prints, X-rays, photographs, FATHEADS® wall murals, etc.), it can be advantageous to roll the items so that they may be placed in shipping containers such as, for example, the shipping containers disclosed in Erdie, U.S. Pat. No. 7,296,730 B2. The sheet stock, when properly rolled, has no fold-lines or wrinkles and is thus protected during shipment.

Conventionally, sheet stock is manually rolled into a cylindrical form and then inserted into a shipping container. As this is a manual process, it is time consuming and inconsistent. This results in increased labor costs for packing and increased customer dissatisfaction when the rolled appearance of the sheet stock varies between shipments because of human variability during the rolling process. In addition, manual rolling can damage the sheet stock via bending and/or via the transfer of oils and other debris from the hands if the individual does not exercise due care while rolling the sheet stock.

BRIEF SUMMARY OF THE INVENTION

A sheet rolling device that can overcome at least some of the aforementioned shortcomings includes a mandrel that selectively retains the sheet stock between a sidewall of the mandrel and a gripper blade of the mandrel. The sidewall defines a cavity of the mandrel. The sheet rolling device also includes a sensor that detects a presence and an absence of the sheet stock near the mandrel, a controller operably associated with the mandrel so as to cause a motor to rotate the mandrel to wind the sheet stock around the mandrel, and an expansion leaf operably associated with the controller and situated along at least a portion of an exterior of the sidewall of the mandrel. Extension of the expansion leaf away from the sidewall increases an effective perimeter of the mandrel about which the sheet stock may be wound and retraction of the expansion leaf toward the sidewall decreases the effective perimeter of the mandrel about which the sheet stock may be wound.

According to another aspect, a method of winding sheet stock, includes sensing a leading edge of the sheet stock with a sensor that is disposed in a table top, extending a lift bar toward the mandrel so that the lift bar is coplanar and aligned with a working surface of the table top and a gripper blade of a mandrel, and feeding the leading edge into a gripper groove that is defined by the sidewall of the mandrel and the gripper blade. The method also includes actuating a gripper pin located at least partially in the mandrel so as to capture the leading edge of the sheet stock between the gripper pin and the gripper blade, retracting the lift bar in a direction away from the mandrel so that the lift bar is misaligned with the working surface and the gripper blade, extending an expansion leaf from the mandrel so as to increase an effective circumference of the mandrel about which the sheet stock may be wound, and rotating the mandrel so as to wind the sheet stock around the mandrel with the increased effective circumference. The method further includes sensing a trailing edge of the sheet stock with the sensor, braking the mandrel so as to reduce a frequency of rotation of the mandrel, retracting the expansion leaf toward the mandrel so as to decrease the effective circumference of the mandrel, and releasing the leading edge of the sheet stock from between the gripper pin and the gripper blade.

The foregoing and other features are hereinafter more fully described and particularly pointed out in the claims, the following description setting forth in detail certain illustrative embodiments, these being indicative, however, of but a few of the various ways in which the principles may be employed.

DETAILED DESCRIPTION OF THE INVENTION

Figure 1:
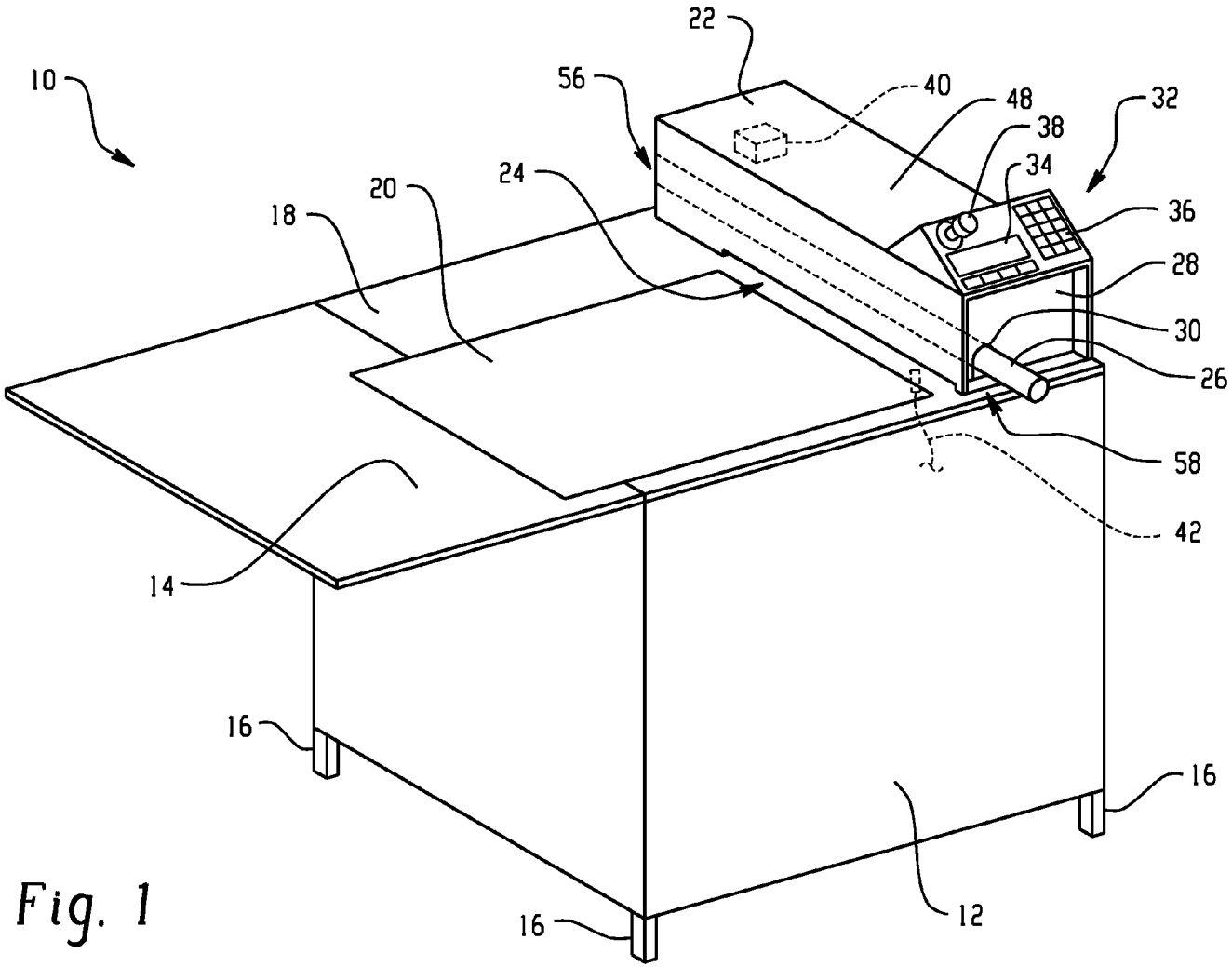
FIG. 1 is a perspective view of a roll-up machine.

With reference to the accompanying drawing figures, and particularly FIG. 1, a roll-up machine or sheet rolling device, 10 can include a table frame 12 upon which a table top 14 is attached. The table frame 12 may include legs 16 as shown, but it is not required. The table top 14 includes a working surface 18 that extends in a generally horizontal manner and can be planar to aid in operation of the roll-up machine 10 as will be discussed hereinbelow. The table frame 12 and the table top 14 may be constructed of any number of materials that provide adequate strength to support the various components.

Sheet stock 20 is shown on the table top 14 and specifically on the working surface 18 of the table top 14. Sheet stock 20 may be made of a paper based material as is known in the art. Furthermore, the sheet stock 20 may also be metal foil and/or plastic films. The sheet stock 20 is not limited by any specific material. Sheet stock may be recognized in general as calendars, posters, and architectural prints, but other products are possible and contemplated. While illustrated as being rectangular shaped, the sheet stock 20 may be any number of shapes, including for example, circular or oval.

With continued reference to FIG. 1, a housing 22 is also illustrated as being located on the working surface 18 of the table top 14. The housing 22 may be made of a variety of metallic, polymer, or composite materials that are suitable for construction. While the housing 22 is shown as rectangular shaped from a plan view, other shapes are possible and contemplated. As illustrated in FIG. 1, the sheet stock 20 is awaiting insertion into a gap 24 of the housing 22. Operation of the roll-up machine 10 allows the sheet stock 20 to be wound into a rolled up form around a mandrel 26 for easy packaging for shipment or archival purposes.

The gap 24 is located at a side of the housing 22 to allow insertion of the sheet stock 20 into the housing 22. In particular, the gap 24 has a width that is sufficient to accommodate a variety of widths of sheet stock 20. Further, the gap 24 has a height to accommodate a variety of thicknesses of sheet stock and can allow the insertion of multiple sheet stocks into the housing 22 at once. It will be appreciated that the roll-up machine 10 could be utilized without the housing 22. Rather, the various components of the roll-up machine 10 could be connected to the table top 14 or other suitable support structure. The housing 22 helps to isolate the various components from any persons nearby, thereby minimizing the risk of injury from operation of the roll-up machine 10.

With continued reference to FIG. 1, the housing 22 can include a front face 28 with a port 30 for passage of a portion of the mandrel 26 and also for removal of the sheet stock 20 once winding of the sheet stock 20 around the mandrel 26 has been completed. The housing 22 may also include a control panel 32 with a display 34 for feedback to an operator, input buttons 36 for the customization of operation, and an E-stop button 38 to immediately stop operation of the roll-up machine 10. The various components of the roll-up machine 10 will now be explained, with a detailed description of operation of the roll-up machine 10 following thereafter.

Figure 9:
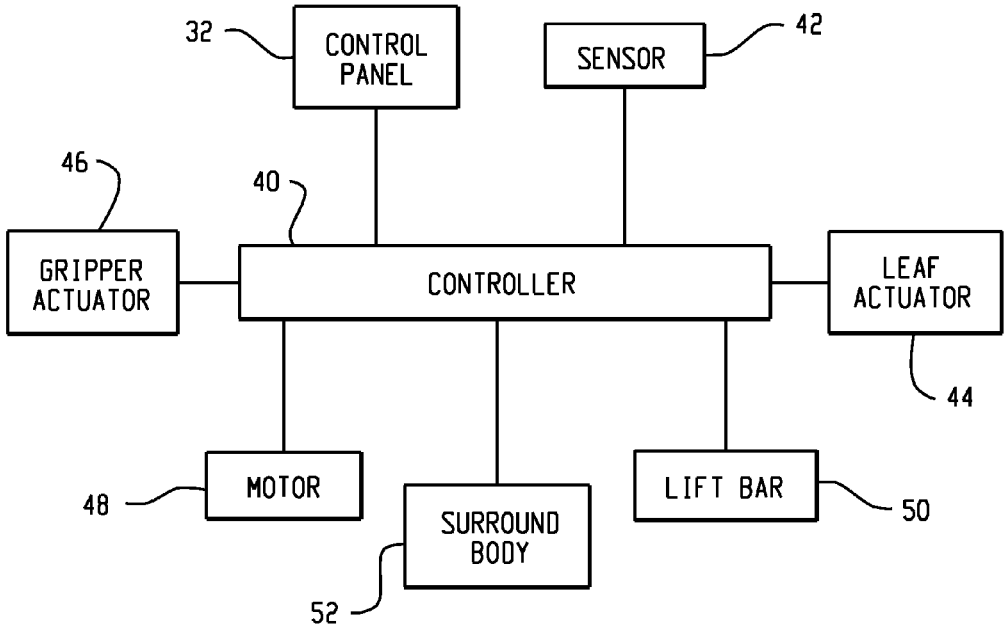
FIG. 9 is an electrical schematic of the roll-up machine.

A controller 40 can also be located within the housing 22. As shown in FIG. 9, the controller 40 is linked to a sensor 42, a leaf actuator 44, a gripper actuator 46, a motor 48, a lift bar 50, a surround body 52, and the control panel 32. The controller 40 may be a commercially available device that provides for the control and operation of a variety of electronic components. While FIG. 9 illustrates that the components are physically connected, it is understood, that the controller 40 may be connected to the various components by other techniques, such as wireless communication methods.

Figure 2:
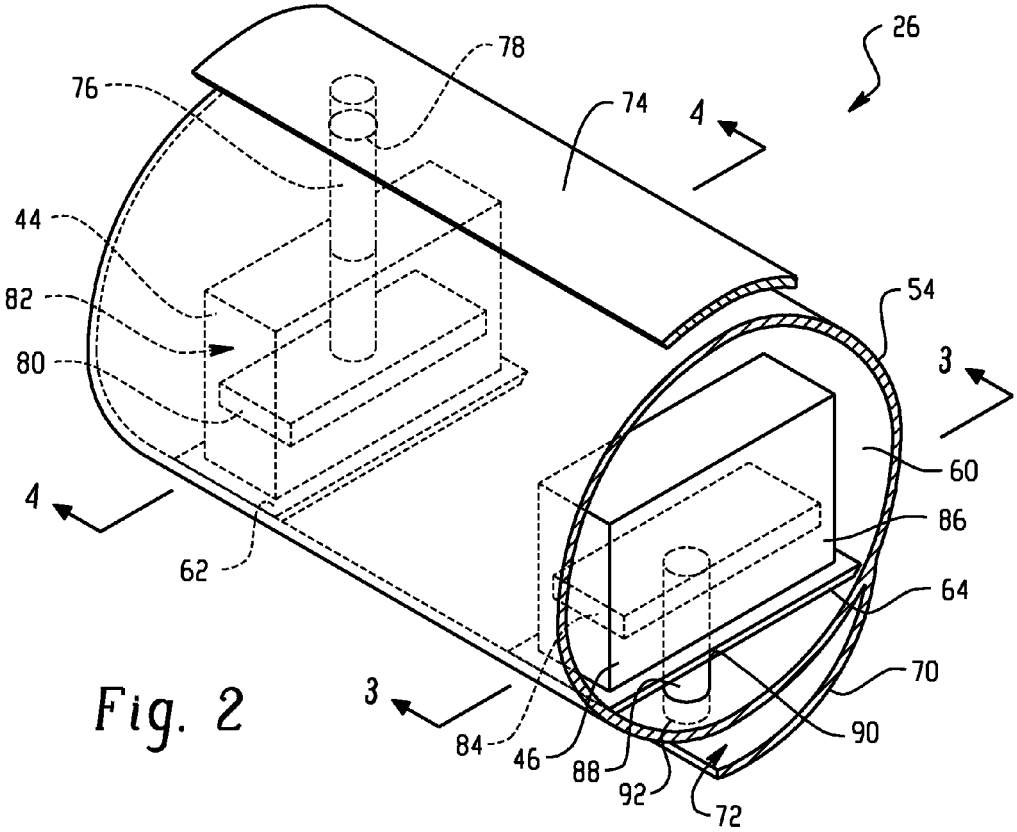
FIG. 2 is a perspective view of a mandrel of the roll-up machine of FIG. 1.

As shown in FIG. 1, the mandrel 26 extends at least partially within the housing 22 and is rotatably supported at a first end 56 of the mandrel 26. A second end 58 of the mandrel 26 passes through the port 30 of the front face 28 of the housing 22 that does not support the mandrel 26, thereby allowing the sheet stock 20 to be removed through the port 30. The mandrel 26 may be of metallic, polymer, or composite construction. Other materials are also envisioned. With reference to FIG. 2, the mandrel 26 is shown with a curved sidewall 54, thereby resulting in the mandrel 26 having a generally circular cross-section. It is understood that other shapes of the mandrel 26 are possible and contemplated. The sidewall 54 defines a cavity 60 of the mandrel 26. However, the mandrel 26 does not need to be of closed form construction. Instead, the mandrel 26 could be made up of pieces of flat stock material.

The mandrel 26 also includes a leaf base 62 and a gripper base 64. The leaf base 62 and the gripper base 64 each extends within the cavity 60 of the mandrel 26 between the sidewall 54 for receipt of the respective leaf actuator 44 or gripper actuator 46. While illustrated as being separate components, it is understood that the leaf base 62 and the gripper base 64 could be integrated into a single base. Further, while the leaf base 62 and the gripper base 64 are shown as being as separate components from the mandrel 26, the bases 62,64 could instead be integrally formed with the mandrel 26.

Figure 5:
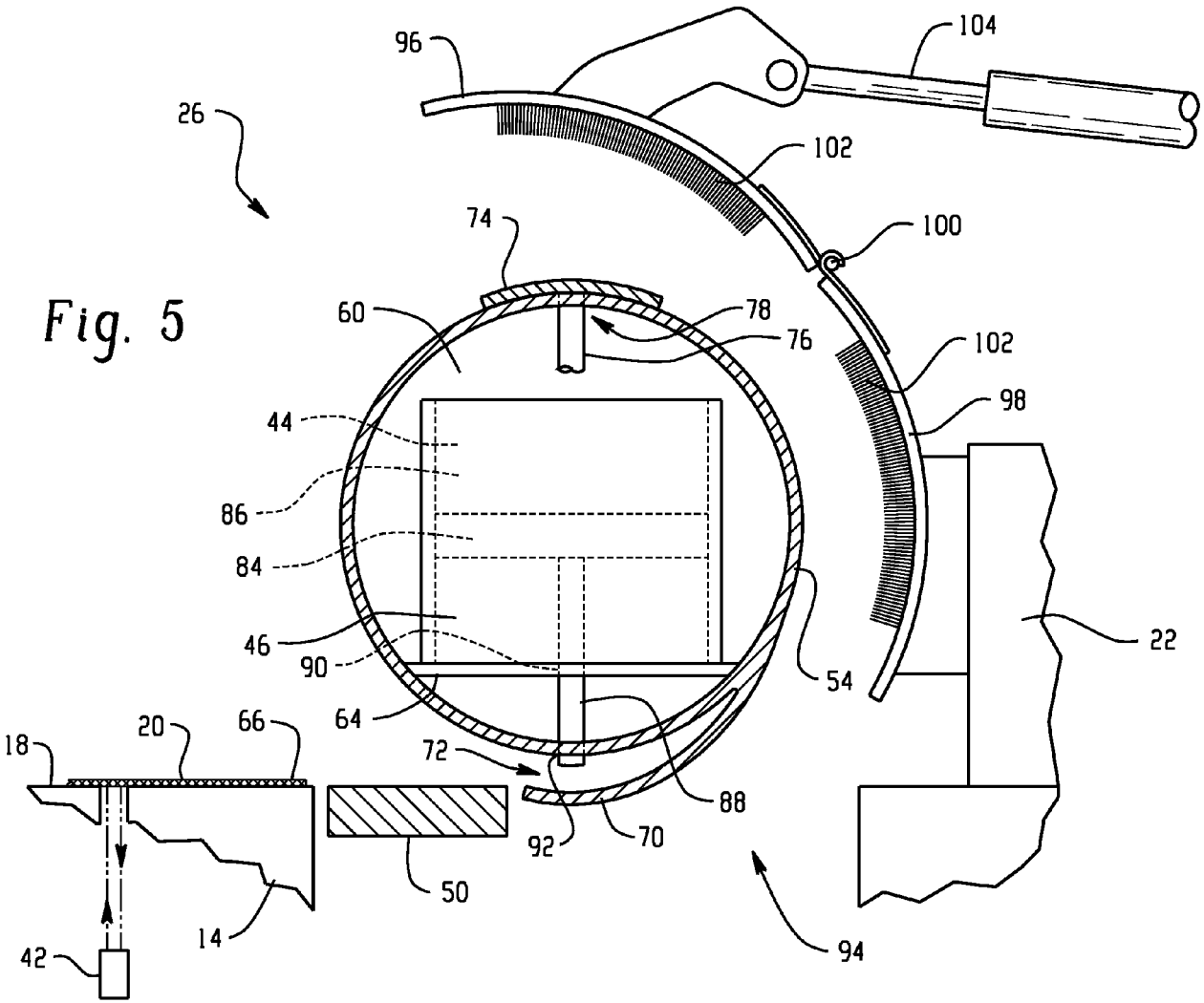
FIG. 5 is an elevation view of an interior of the roll-up machine prior to receipt of the sheet stock by the mandrel.
Figure 6:
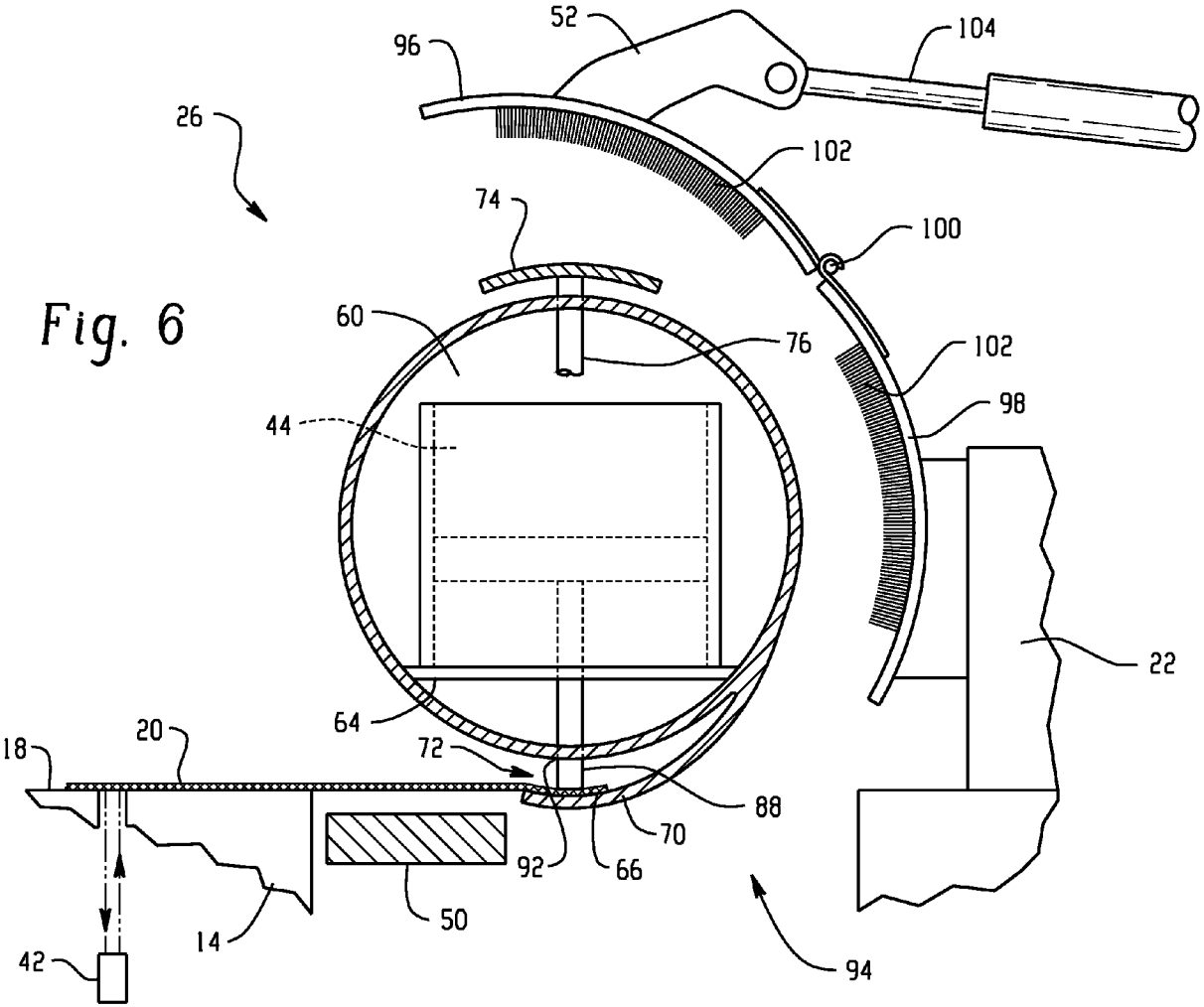
FIG. 6 is an elevation view of the interior of the roll-up machine upon initial receipt of the sheet stock by the mandrel.
Figure 7:
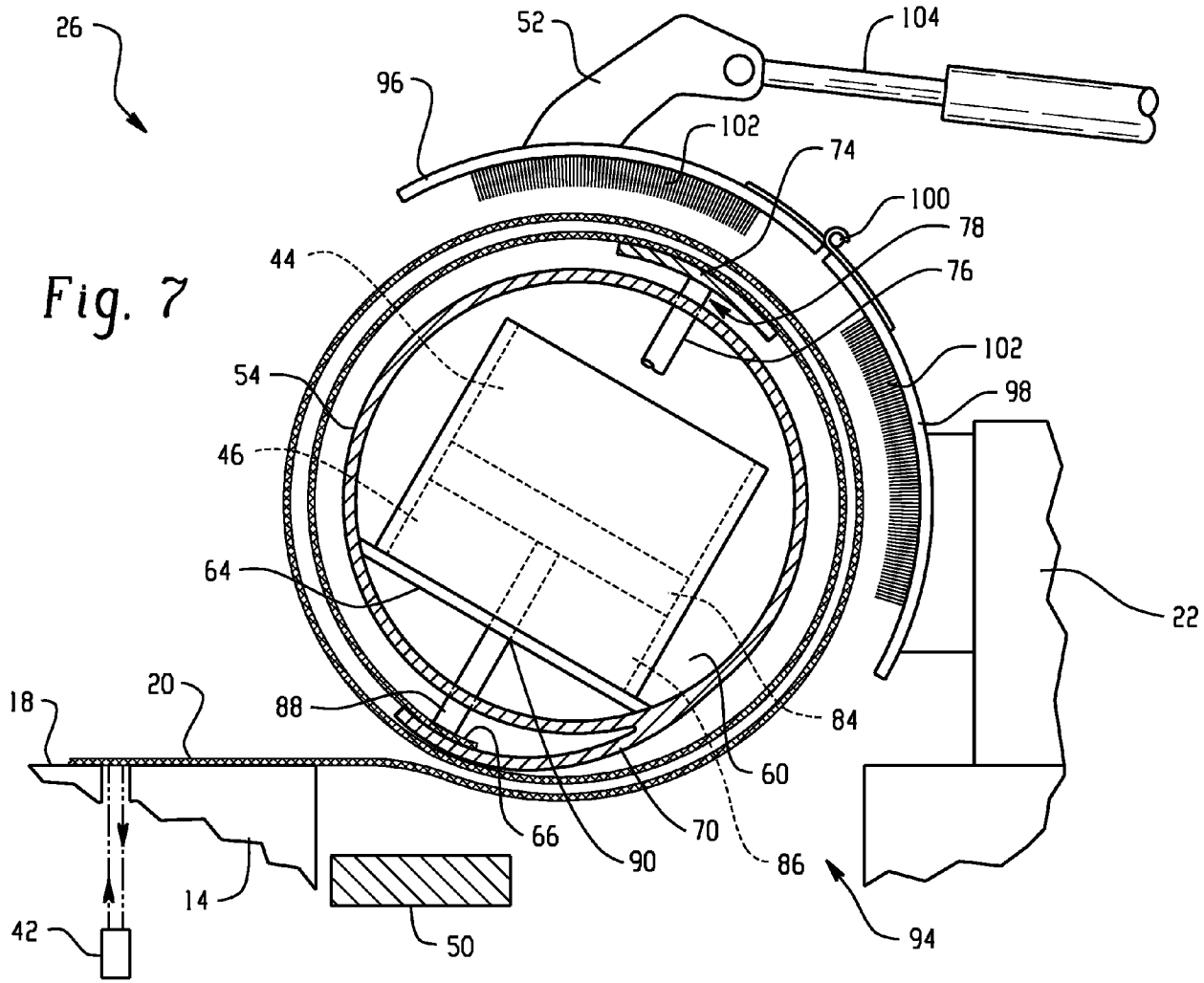
FIG. 7 is an elevation view of the interior of the roll-up machine during winding of the sheet stock by the mandrel.
Figure 8:
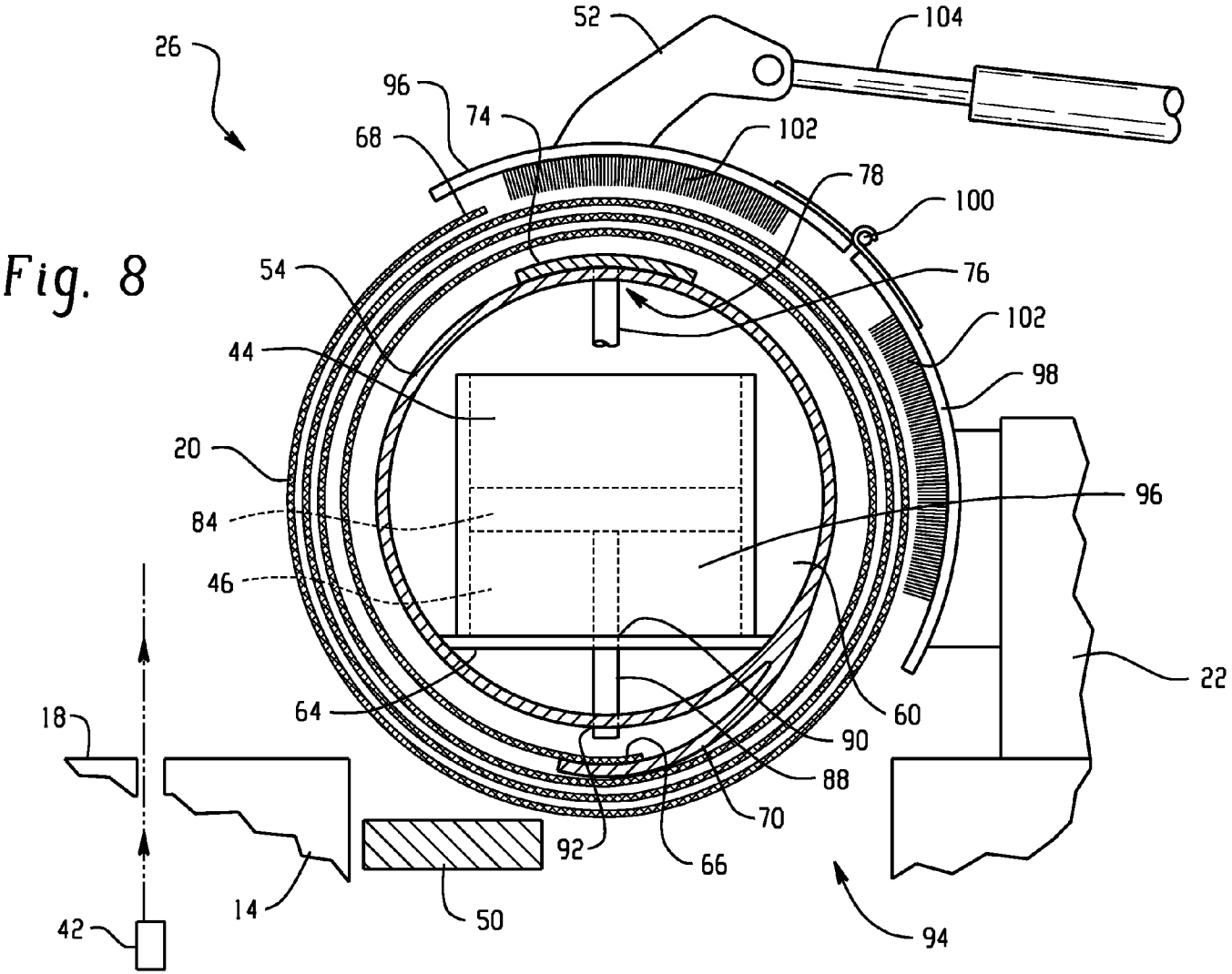
FIG. 8 is an elevation view of the interior of the roll-up machine upon completion of winding of the sheet stock by the mandrel.

With reference to FIGS. 5-8, located near the gap 24 is the sensor 42. The sensor 42 can be disposed below the working surface 18 of the table top 14. As mentioned hereinabove, the sensor 42 is in communication with the controller 40. FIG. 5 illustrates a snapshot in time shortly after the sensor 42 has sensed a leading edge 66 of the sheet stock 20 passing by the sensor 42, while FIG. 8 shows the sensor 42 sensing that a trailing edge 68 of the sheet stock 20 has just passed by the sensor 42. The sensor 42 may be an optical type sensor, such as a photo-eye. However other sensors and sensor techniques for sensing the leading edge 66 and the trailing edge 68 of the sheet stock 20 are possible and contemplated. Because of the sensor 42, the roll-up machine 10 can wind sheet stock of varying lengths without adjustment, thereby saving time and eliminating the risk of an operator incorrectly setting up the machine 10. This translates into a cost savings from decreased labor and also reduced sheet stock damage.

With reference to FIGS. 2-6, the mandrel 26 further includes a gripper blade 70 that extends from the sidewall 54. The gripper blade 70 is spaced from the sidewall 54 to define a gripper groove 72 for receipt of the sheet stock 20, as shown in FIG. 6. The gripper blade 70 may be integral with the sidewall 54, or may be a separate component. Further, the gripper blade 70 may have a curvature that is similar to the sidewall 54 of the mandrel 26. The gripper blade 70 can extend along a length of the mandrel 26. As will be discussed in more detail below, the gripper blade 70 cooperates with the sidewall 54 to capture the leading edge 66 of the sheet stock 20 and allow subsequent winding of the sheet stock 20 about the mandrel 26.

Figure 3:
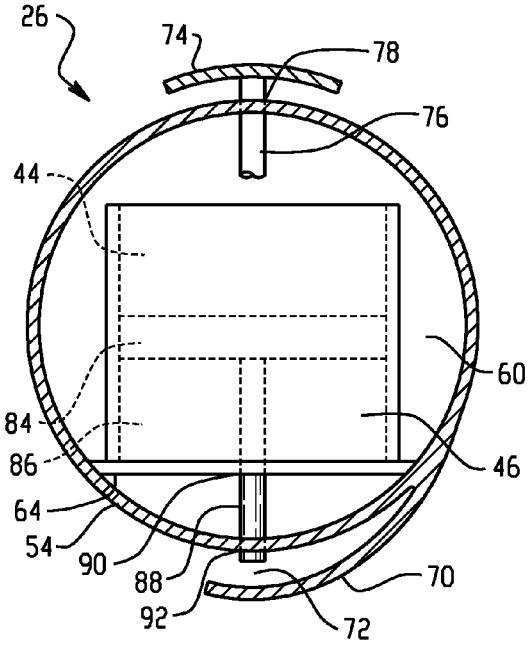
FIG. 3 is a sectional view of the mandrel along line 3-3 of FIG. 2.
Figure 4:
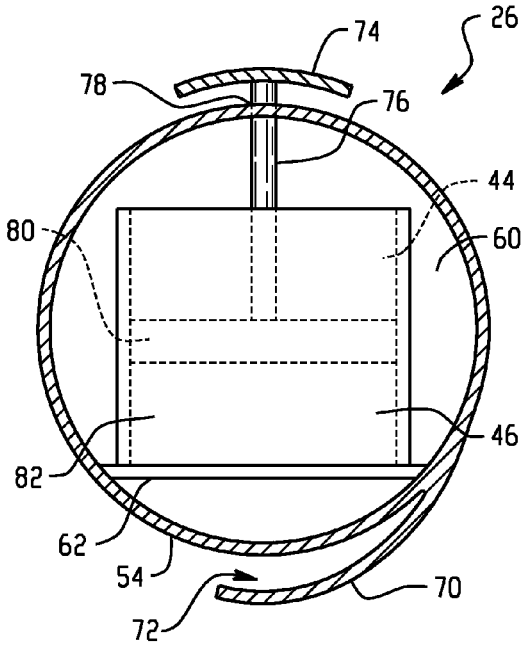
FIG. 4 is a sectional view of the mandrel along line 4-4 of FIG. 2

As illustrated in FIGS. 2-3, an expansion leaf 74 is situated along at least a portion of an exterior of the sidewall 54 of the mandrel 26. As shown, the expansion leaf 74 has a curvature that is similar to, or matches, the sidewall 54 of the mandrel 26. However, it is understood that the expansion leaf 74 does not have to be curved or match the curvature of the sidewall 54. Further, the expansion leaf 74 extends along a length of the mandrel 26. The expansion leaf 74 may be constructed of any material that provides sufficient rigidity for receipt of the sheet stock 20 during winding without significant deformation. The expansion leaf 74 is coupled to the leaf actuator 44 as will be discussed below.

With continued reference to FIGS. 2-3, the leaf actuator 44 is shown connected to the expansion leaf 74 that is situated on the leaf base 62 of the mandrel 26. Although not illustrated, it is considered apparent that the leaf actuator 44 includes an interface module for communication with the controller 40. A connecting rod 76 of the leaf actuator 44 passes through an expansion opening 78 in the sidewall 54 to connect the expansion leaf 74 to a leaf piston 80 that is housed in a leaf chamber 82. By supplying compressed air or hydraulic fluid to the leaf chamber 82, the leaf piston 80 moves either toward or away from the leaf base 62. When the leaf piston 80 moves, the motion is transmitted to the connecting rod 76 that is attached to the expansion leaf 74. The leaf actuator 44 may be a dual action pneumatic cylinder assembly in which different fluid flow result in opposite linear movement of the leaf piston 80. Alternatively, the leaf actuator 44 may be a single action pneumatic cylinder assembly that includes a spring to bias the connecting rod 76, and hence the expansion leaf 74, in a direction opposite that of extension of the connecting rod 76 when fluid is supplied to the leaf chamber 82.

Movement of the leaf piston 80 away from the leaf base 62 translates into extension of the connecting rod 76 through the expansion opening 78 in the sidewall 54 and extension of the expansion leaf 74 away from the sidewall 54, thereby increasing an effective perimeter of the mandrel 26 about which the sheet stock 20 may be wound. For reference, FIG. 7 shows the expansion leaf 74 is the expanded position. Conversely, movement of the leaf piston 80 toward the leaf base 62 translates into retraction of the connecting rod 76 through the expansion opening 78 and retraction of the expansion leaf 74 toward the sidewall 54, thereby decreasing the effective perimeter of the mandrel 26 about which the sheet stock 20 may be wound. FIG. 8 illustrates the expansion leaf 74 in the retracted position.

When the mandrel 26 and the expansion leaf 74 are somewhat circular or curved in cross-section, it is understood that the effective perimeter could also be referred to as an effective circumference. As will be explained in more detail hereinafter, the expansion leaf 74 can be extended prior to winding of the sheet stock 20 and then retracted after winding is completed, but before the sheet stock 20 is removed from the mandrel 26. This eases removal of the sheet stock 20 from the mandrel 26, as the sheet stock 20 has a larger inner circumference or diameter than the mandrel 26 effective perimeter or circumference. While the leaf actuator 44 is illustrated as being a single unit, it is understood that there could be multiple expansion leafs and related leaf actuators disposed along the length of the mandrel 26. Furthermore, it is appreciated that the sheet stock 20 could be wound around the mandrel 26 when the mandrel 26 has a usual operating circumference and then the mandrel 26 could be reduced in size so as to have a reduced circumference, where the reduced circumference is less than the usual operating circumference.

With reference to FIGS. 2-3, a gripper piston 84 is received in a gripper chamber 86 that can be located at least partially in the cavity 60. Although not illustrated, it is considered apparent that the gripper chamber 86 includes an interface module for communication with the controller 40. The gripper piston 84 is attached to a gripper pin 88 that passes through a gripper base bore 90 in the gripper base 64 upon which the gripper chamber 86 is situated. The gripper pin 88 further passes through a gripper hole 92 in the sidewall 54 of the mandrel 26. The gripper pin 88 selectively holds the sheet stock 20 in the gripper groove 72 of the mandrel 26. The gripper piston 84 serves as a connecting rod to transmit motion from the gripper piston 84 and also as an engagement member for contacting the sheet stock 20 when in the gripper groove 72. The gripper piston 84 and gripper chamber 86 can function in a manner similar to the leaf piston 80 and the leaf chamber 82. Accordingly, a detailed description will be omitted. Movement of the gripper piston 84 toward the gripper base 64 results in the gripper pin 88 extending through the gripper hole 92 toward the gripper blade 70, thereby engaging sheet stock 20 that is present in the gripper groove 72, as shown in FIG. 6. Movement of the gripper piston 84 away from the gripper base 64 results in the gripper pin 88 retracting through the gripper hole 92 away from the gripper blade 70, thereby permitting the sheet stock 20 to be released from the mandrel 26, as illustrated in FIG. 8.

The mandrel 26 is driven by the motor 48, which may also be located in the housing 22. Alternatively, the motor 48 may be situated at a location outside of the housing 22, as long as the location allows for the motor 48 to be coupled to the mandrel 26. The motor 48 includes an interface module for communication with the controller 40. The motor 48 can be coupled to the mandrel 26 in a traditional manner, such as a belt linkage or chain, or a direct drive model may be employed that utilizes gears to rotate the mandrel 26. The motor 48 is typical in construction and provides rotational energy to rotate the mandrel 26. It is understood that other devices, such as engines or a compressed air and vane arrangement could alternatively be used to rotate the mandrel 26.

With reference to FIGS. 5-8, the lift bar 50 is shown disposed in the table top 14. In particular, the lift bar 50 is located in a gap 94 of the table top 14 and can slide in an upward and downward direction (e.g., toward and away from the working surface 18 and the mandrel 26). As illustrated, the lift bar 50 has a rectangular cross-section, however other shapes are possible. For example, the lift bar 50 could have a rounded shape to ease the sheet stock 20 into the gripper groove 72. The lift bar 50 may be constructed of any material of adequate rigidity to guide the sheet stock 20 into the gripper groove 72 of the mandrel 26. The lift bar 50 is moved by a commercially available actuator (not shown) that includes an interface module that is in communication with the controller 40. The lift bar 50 moves between an extended position in which the lift bar 50 is coplanar and aligned with the working surface 18 and the guide groove (e.g., FIG. 5), and a retracted position in which the lift bar 50 is misaligned with the working surface 18 of the table top 14 and the gripper groove 72 (e.g., FIGS. 6-8). While in the extended position, the lift bar 50 helps to guide the leading edge 66 of the sheet stock 20 into the gripper groove 72 without damaging the sheet stock 20. In the retracted position, the lift bar 50 is removed from working surface 18 to prevent contact with the sheet stock 20 as the sheet stock 20 is being wound onto the mandrel 26. Further, the retracted position allows a wound sheet stock 20 with a larger outer diameter to be accommodated on the mandrel 26 than if the lift bar 50 were in the extended position. Coordination of the lift bar 50 with the other components of the sheet rolling device will be discussed hereinafter.

With continued reference to FIGS. 5-8, the surround body 52 is shown. The surround body 52 ensures that the sheet stock 20 remains sufficiently tightly wound during and after rotation of the mandrel 26. The surround body 52 may be made of the same material as the housing 22, however other materials are possible. The surround body 52 at least partially surrounds the mandrel 26 and can be separated into an upper portion 96 and a lower portion 98 that are joined by a hinge 100. The hinge 100 allows the upper portion 96 to be movable, while the lower portion 98 can be fixably attached to the housing 22. This allows the surround body 52 to be at least partially pivoted away from the mandrel 26 for maintenance and also for optimal operation as will be discussed below.

The surround body 52 can further include a friction member 102 that extends between the upper and lower portions 96,98 of the surround body 52 and the mandrel 26. The friction member 102 may be any type of material that is non-marring and somewhat flexible to ensure that the sheet stock 20 remains tightly wrapped around the mandrel 26, but is not damaged. A link 104 is attached to the upper portion 96 of the surround body 52 and also to an actuator (not shown) that includes an interface module that is in communication with the controller 40. Based upon instructions from the controller 40 to the actuator, the link 104 is actuated so as to pivot the upper portion 96 of the surround body 52 about the hinge 100, thereby increasing or decreasing the distance between the surround body 52 and the mandrel 26.

It will be appreciated that while only one gripper actuator 46 and one expansion leaf 74 with leaf actuator 44 are shown, multiple gripper assemblies and/or expansion leaves and actuators could be utilized with a mandrel. Further, the gripper actuator 46 and the expansion leaf 74 with the leaf actuator 44 could be sized to extend along most or the entire length of the mandrel 26.

Operation of the roll-up machine 10 will now be discussed. As shown in FIG. 5, the sheet stock 20 has just entered the housing 22 and the sensor 42 has detected the leading edge 66 of sheet stock 20. This information is transmitted to the controller 40. The controller 40 then instructs the lift bar actuator to move the lift bar 50 so that the lift bar 50 is aligned and coplanar with the working surface 18 and the gripper groove 72. Further, the controller 40 ensures that the gripper pin 88 is in the retracted position to maximize a distance between the gripper pin 88 and the gripper blade 70. Also, the controller 40 ensures that the leaf actuator 44 is homed so that the expansion leaf 74 is near to the sidewall 54 and the surround body 52 is also set to a maximum distance between the upper portion 96 of the surround body 52 and the mandrel 26.

As illustrated in FIG. 6, the controller 40 instructs the gripper pin 88 to extend to capture the leading edge 66 of the sheet stock 20 between the gripper pin 88 and the gripper blade 70. This instruction to extend the gripper pin 88 is after a predetermined delay to allow the leading edge 66 of the sheet stock 20 to enter the gripper groove 72. Further, the controller 40 instructs the leaf actuator 44 to extend the connecting rod 76 from the expansion opening 78 to increase a distance between the expansion leaf 74 and the sidewall 54, and for the lift bar 50 to retract so as to move away from the working surface 18 and the mandrel 26.

As shown in FIG. 7, the controller 40 has instructed the motor 48 to rotate to wind the sheet stock 20 about the mandrel 26. Further, the upper portion 96 of the surround body 52 has been slightly rotated toward the mandrel 26 so as to nearly contact the wound sheet stock 20. At this time, the gripper pin 88 and the expansion leaf 74 remain in the same position as illustrated in FIG. 6.

In FIG. 8, the sensor 42 senses the trailing edge 68 of the sheet stock 20. After a short delay, the controller 40 instructs the motor 48 to stop rotation of the mandrel 26. Further, the gripper pin 88 and the expansion leaf 74 retract toward the sidewall 54. Then, the wound sheet stock 20 can be coaxially removed from the mandrel 26 through the port 30 of the housing 22. Optionally, the sheet stock 20 may be slightly rotated in a direction opposite the rotational direction of the mandrel 26 during winding to remove the leading edge 66 of the sheet stock 20 from the gripper groove 72 before coaxial removal of the sheet stock 20 from the mandrel 26.

Now that routine operation of the roll-up machine 10 has been discussed, customized operation will be explained. As shown in FIG. 1, the housing 22 includes the control panel 32 with the display 34, the input buttons 36, and the E-stop button 38. As mentioned hereinbefore, the control panel 32 is connected to the controller 40. The display 34 allows a user to view current settings of the roll-up machine 10 and also to view error codes associated with operation. Further, the input buttons 36 allows the user to program the controller 40 to adjust numerous parameters of operation of the roll-up machine 10. For example, the user can adjust the delay between when the leading edge 66 and/or the trailing edge 68 of the sheet stock 20 are sensed and when a specific operation takes place. Further, the user can select the speed at which the motor 48 rotates the mandrel 26. Additionally, the user can adjust the distance between the upper portion 96 of the surround body 52 and the mandrel 26 during operation of the roll-up machine 10. Finally, if the user depresses the E-stop button 38, the motor 38 immediately stops rotation of the mandrel 26 and also any movement of any actuators.

Figure 10:
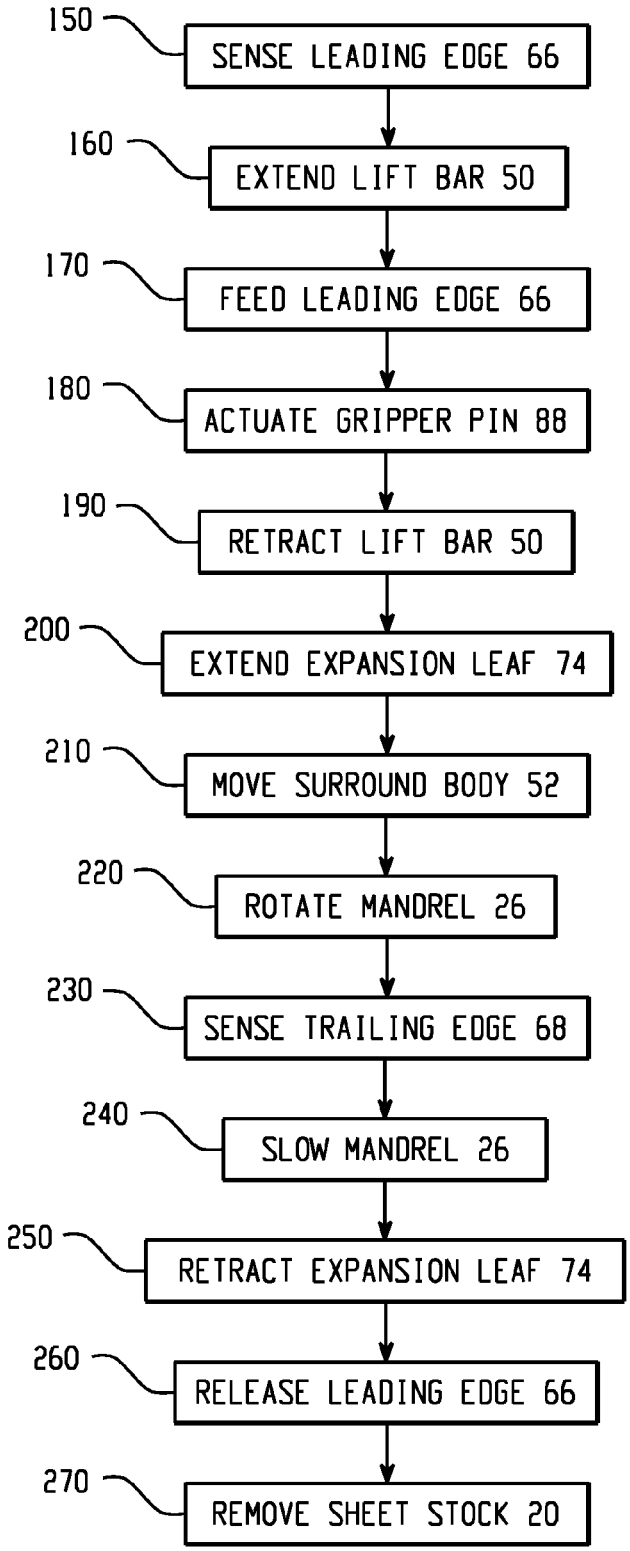
FIG. 10 is a flowchart illustrating a method of winding sheet stock.

A method of winding sheet stock 20 is shown in FIG. 10. The method is described with respect to the embodiment in FIGS. 1-9; however other roll-up machines are contemplated. The following steps are described in logical order, but the appended claims are not limited to the order described. At 150, a leading edge 66 of the sheet stock 20 is sensed. At 160, a lift bar 50 is extended toward the mandrel 26 and at 170, the leading edge 66 is fed into a gripper groove 72. At 180, the gripper pin 88 is actuated to capture the leading edge 66 of the sheet stock 20, and at 190 the lift bar 50 is retracted. At 200, the expansion leaf 74 is extended and at 210 a surround body 52 is moved toward the mandrel 26. At 220, the mandrel 26 is rotated. At 230, a trailing edge 68 of the sheet stock 20 is sensed and at 240, the mandrel 26 is slowed. At 250, the expansion leaf 74 is retracted and at 260, the leading edge 66 of the sheet stock 20 is released. At 270, the sheet stock 20 is slightly rotated in a direction opposite the rotational direction of the mandrel 26 during winding and the sheet stock 20 is coaxially removed from the mandrel 26.

Figure 11A:
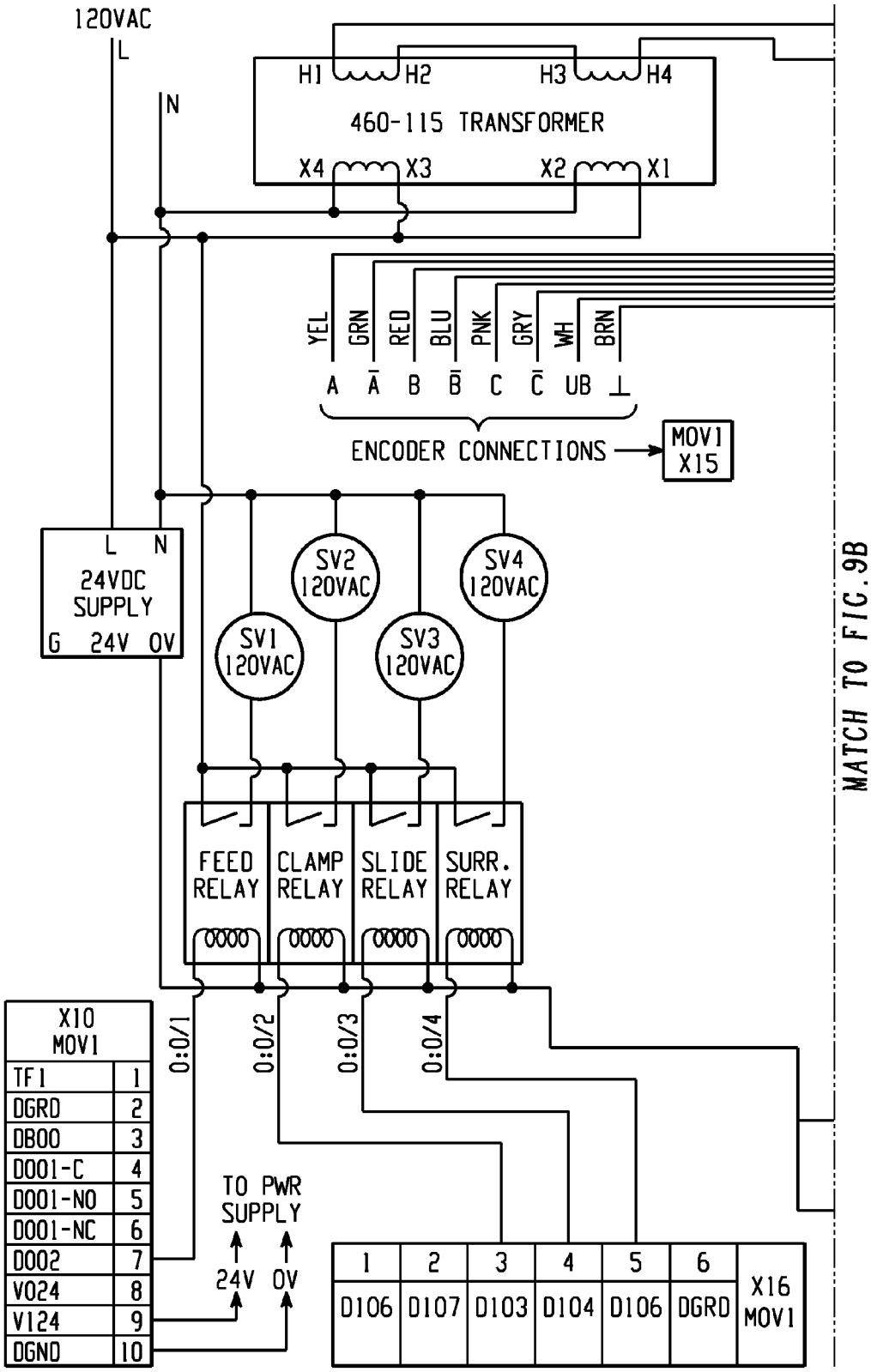
FIGS. 11A and 11B show electrical wiring and circuitry for a preferred embodiment of a roll-up machine according to the invention.
Figure 11B:
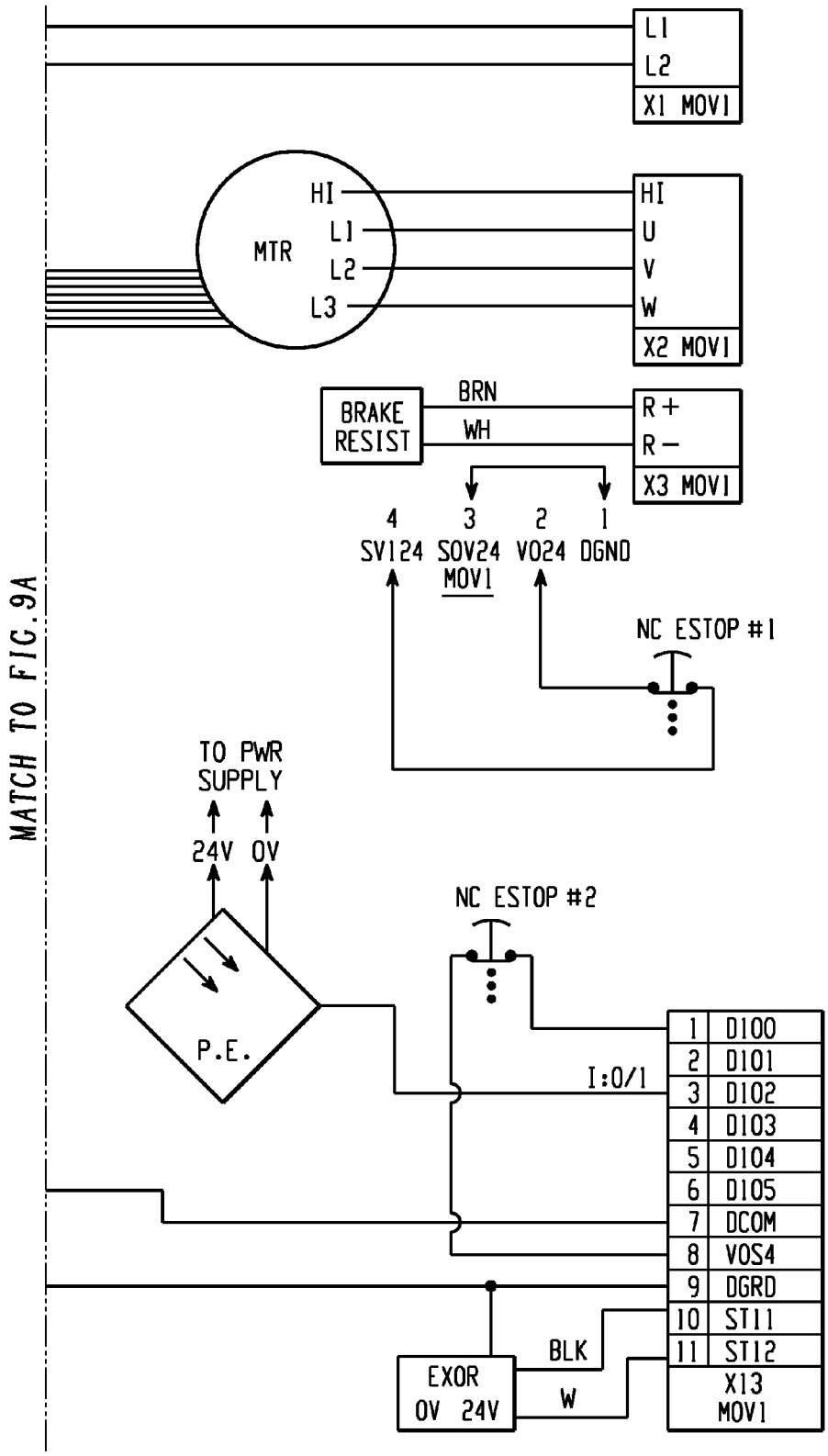
Figure 12:
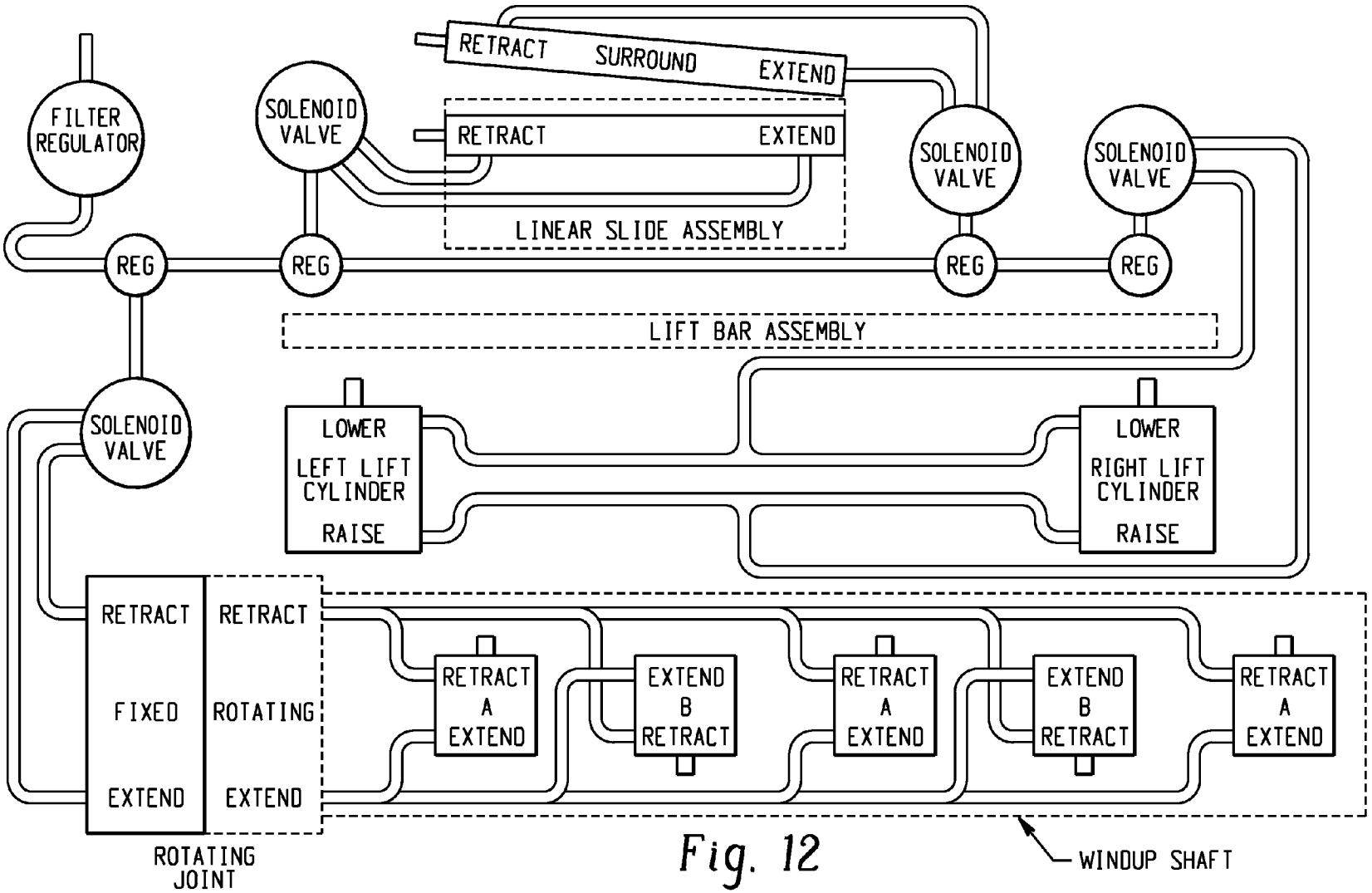
FIG. 12 shows pneumatic circuitry for a preferred embodiment of a roll-up machine according to the invention.

FIGS. 11A and 11B show electrical wiring and circuitry for a preferred embodiment of a roll-up machine according to the invention. And, FIG. 12 shows pneumatic circuitry for a preferred embodiment of a roll-up machine according to the invention.

As used herein, terms such as "above . . . below . . . up . . . down . . . horizontally" are not intended to limit the appended claims, but are used for ease of description of the relationship of various parts of the illustrated embodiment, it being apparent that various orientations of a sheet rolling device are possible depending upon the environments employed.

It will be appreciated that the above-disclosed and other features and functions, or alternatives or varieties thereof, may be desirably combined into many other different systems or applications. For example, an automatic sheet feeder could be added to supply the sheet stock 20 to the wind-up machine 10. This would allow the wind-up machine 10 to operate without an operator manually feeding the sheet stock 20 into the machine 10. Further, an automatic unloader could be associated with the wind-up machine 10. The automatic unloader would coaxially remove the wound sheet stock 20 from the mandrel 26 and then place the wound sheet stock 20 into shipping containers or other desired storage devices. The automatic unloader could also slightly rotate the sheet stock 20 prior to removal from the mandrel 26 as mentioned hereinbefore. Also presently unforeseen or unanticipated alternatives, modifications, variations or improvements therein may be subsequently made by those skilled in the art which are also intended to be encompassed by the following claims.

What is claimed is:

1. A sheet rolling device for winding sheet stock, comprising:

a mandrel that selectively retains the sheet stock between a sidewall of the mandrel and a gripper blade of the mandrel, wherein the sidewall defines a cavity of the mandrel;

a sensor that detects a presence and an absence of the sheet stock near the mandrel;

a controller operably associated with the mandrel so as to cause a motor to rotate the mandrel to wind the sheet stock around the mandrel; and an expansion leaf operably associated with the controller and situated along at least a portion of an exterior of the sidewall of the mandrel, wherein extension of the expansion leaf away from the sidewall increases an effective perimeter of the mandrel about which the sheet stock may be wound and retraction of the expansion leaf toward the sidewall decreases the effective perimeter of the mandrel about which the sheet stock may be wound.

2. The sheet rolling device of claim 1, further comprising:

a leaf actuator at least partially disposed within the mandrel, wherein the leaf actuator is coupled to the expansion leaf and allows the expansion leaf to move toward or away from the sidewall upon the leaf actuator receiving instructions from the controller.

3. The sheet rolling device of claim 2, further comprising:

a gripper pin that extends through the sidewall so as to selectively trap the sheet stock between an end of the gripper pin and the gripper blade.

4. The sheet rolling device of claim 3, further comprising:
a gripper actuator at least partially disposed within the sidewall of the mandrel, wherein the gripper actuator is coupled to the gripper pin and allows the gripper pin to move toward or away from the gripper blade upon the gripper actuator receiving instructions from the controller.

5. The sheet rolling device of claim 4, further comprising:
a base that extends within the cavity between the sidewall for receipt of the gripper actuator and the leaf actuator.

6. The sheet rolling device of claim 1, further comprising:
a surround body that at least partially surrounds the mandrel.

7. The sheet rolling device of claim 6, wherein the surround body is hinged to pivotably connect an upper movable portion of the surround body and a lower fixed portion of the surround body.

8. The sheet rolling device of claim 7, wherein the surround body includes a friction member that extends between the surround body and the mandrel.

9. The sheet rolling device of claim 8, wherein the upper portion of the surround body is actuatable so that the friction member of the upper portion can nearly contact the sheet stock that is wound about the mandrel.

10. The sheet rolling device of claim 1, wherein the mandrel is circular in cross section and the expanding leaf and the gripper blade each have a curvature to complement the mandrel.

11. The sheet rolling device of claim 1, wherein the gripper blade extends from the sidewall of the mandrel to define a groove for receipt of the sheet stock between the sidewall and the gripper blade.

12. A roll-up machine for winding sheet stock, comprising:
a mandrel that selectively retains the sheet stock between a sidewall of the mandrel and a gripper blade of the mandrel, wherein the gripper blade extends from the sidewall so as to generally match a curvature of the sidewall, thereby creating a gripper groove for receipt of a leading edge of the sheet stock;
a sensor that detects a presence and an absence of the leading edge and a trailing edge of the sheet stock near the mandrel;
a controller operably associated with the mandrel so as to cause a motor to rotate the mandrel to wind the sheet stock around the mandrel;
a housing that rotatably supports the mandrel at a first end of the mandrel and at least partially encloses the controller, wherein the housing also includes an opening for passage of a second end of the mandrel, the second end being opposite the first end of the mandrel;
an expansion leaf that is situated along at least a portion of an exterior of the sidewall of the mandrel;
an leaf actuator at least partially disposed within the mandrel, wherein the leaf actuator is coupled to the expansion leaf and allows the expansion leaf to move toward or away from the sidewall upon receiving instructions from the controller and wherein extension of the expansion leaf away from the sidewall increases an effective perimeter of the mandrel;
a generally horizontally extending table top that supports the housing and includes an aperture for receipt of the sensor, wherein a working surface of the table top and the gripper blade of the mandrel are generally coplanar; and
a lift bar slidably received in the table top, wherein the lift bar is movable between an extended position in which the lift bar is generally coplanar and aligned with the working surface of the table top and the gripper groove to a retracted position in which the lift bar is misaligned with the working surface of the table top and the gripper groove.

13. The roll-up machine of claim 12, wherein the lift bar is located in a gap of the table top between the sensor and the gripper blade of the mandrel and movement of the lift bar is in a direction generally parallel to the working surface of the table top.

14. The roll-up machine of claim 12, wherein the sensor is an optical sensor.

15. The roll-up machine of claim 12, further comprising:
a gripper assembly including a gripper pin that selectively squeezes the sheet stock between the sidewall and the gripper blade.

16. The roll-up machine of claim 15, wherein the gripper assembly further includes a gripper actuator at least partially disposed within the mandrel, wherein the gripper actuator is a pneumatic cylinder that is connected to the gripper pin so that the gripper pin may move between an engaged position in which the gripper pin extends from the sidewall toward the gripper blade so as to minimize a distance between the gripper pin and the gripper blade and a released position in which the gripper pin retracts from the gripper blade toward the sidewall so as to maximize the distance the gripper pin and the gripper blade.

17. The roll-up machine of claim 16, wherein the distance between the gripper pin and the gripper blade when the gripper pin is in the engaged position is such that a plurality of sheets of sheet stock may be captured between the gripper pin and the gripper blade.

18. A method of winding sheet stock, comprising:
sensing a leading edge of the sheet stock with a sensor that is disposed in a table top;
extending a lift bar toward the mandrel so that the lift bar is coplanar and aligned with a working surface of the table top and a gripper blade of a mandrel;
feeding the leading edge into a gripper groove that is defined by the sidewall of the mandrel and the gripper blade;
actuating a gripper pin located at least partially in the mandrel so as to capture the leading edge of the sheet stock between the gripper pin and the gripper blade;
retracting the lift bar in a direction away from the mandrel so that the lift bar is misaligned with the working surface and the gripper blade;
extending an expansion leaf from the mandrel so as to increase an effective circumference of the mandrel about which the sheet stock may be wound;
rotating the mandrel so as to wind the sheet stock around the mandrel with the increased effective circumference;
sensing a trailing edge of the sheet stock with the sensor;
braking the mandrel so as to reduce a frequency of rotation of the mandrel;
retracting the expansion leaf toward the mandrel so as to decrease the effective circumference of the mandrel; and
releasing the leading edge of the sheet stock from between the gripper pin and the gripper blade.

19. The method of winding sheet stock of claim 18, further comprising:
coaxially removing the sheet stock from the mandrel.

20. The method of winding sheet stock of claim 18, further comprising:
moving a surround body with a friction member toward the mandrel between extending the expansion leaf and rotating the mandrel.

* * * * *